US009249748B2

(12) United States Patent
Verner

(10) Patent No.: US 9,249,748 B2
(45) Date of Patent: Feb. 2, 2016

(54) SYSTEM AND METHOD FOR CONTROLLING A FIRING SEQUENCE OF AN ENGINE TO REDUCE VIBRATION WHEN CYLINDERS OF THE ENGINE ARE DEACTIVATED

(71) Applicant: GM Global Technology Operations LLC, Detroit, MI (US)

(72) Inventor: Douglas R. Verner, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 471 days.

(21) Appl. No.: 13/798,574

(22) Filed: Mar. 13, 2013

(65) Prior Publication Data

US 2014/0090624 A1 Apr. 3, 2014

Related U.S. Application Data

(60) Provisional application No. 61/709,181, filed on Oct. 3, 2012.

(51) Int. Cl.
*F02D 41/00* (2006.01)
*F02P 9/00* (2006.01)
(Continued)

(52) U.S. Cl.
CPC ..... *F02D 41/0087* (2013.01); *F02D 41/0097* (2013.01); *F02P 9/00* (2013.01); *F02P 9/002* (2013.01); *F02P 9/005* (2013.01); *F02D 41/1497* (2013.01); *F02D 2041/288* (2013.01)

(58) Field of Classification Search
CPC ..... F02D 41/0087; F02D 41/0097; F02D 41/1497; F02D 41/1498; F02D 2041/288; F02P 9/00; F02P 9/002; F02P 9/005
USPC ..... 701/111; 123/198 F, 436, 481
See application file for complete search history.

(56) References Cited

U.S. PATENT DOCUMENTS 4,172,434 A 10/1979 Coles
4,377,997 A 3/1983 Staerzl
(Continued)

FOREIGN PATENT DOCUMENTS

CN 1888407 A 1/2007
CN 101353992 A 1/2009
CN 102454493 A 5/2012

OTHER PUBLICATIONS

U.S. Appl. No. 14/548,501, filed Nov. 20, 2014, Beikmann et al.
(Continued)

*Primary Examiner* — Lindsay Low
*Assistant Examiner* — Robert Werner

(57) ABSTRACT

A system according to the present disclosure includes a spectral density module and a firing sequence module. The spectral density module determines a spectral density of engine speed. The firing sequence module selects a first set of M cylinders of an engine to activate, selects a second set of N cylinders of the engine to deactivate, and selects a firing sequence to activate the first set of M cylinders and to deactivate the second set of N cylinders. M and N are integers greater than or equal to one. The firing sequence specifies whether each cylinder of the engine is active or deactivated. Based on the spectral density, the firing sequence module adjusts the firing sequence to adjust M and N and/or to adjust which cylinders of the engine are included in the first set and which cylinders of the engine are included in the second set.

20 Claims, 7 Drawing Sheets

(51) Int. Cl.
*F02D 41/14* (2006.01)
*F02D 41/28* (2006.01)

(56) References Cited

U.S. PATENT DOCUMENTS 4,434,767 A 3/1984 Kohama et al.
4,489,695 A 12/1984 Kohama et al.
4,509,488 A 4/1985 Forster et al.
4,535,744 A 8/1985 Matsumura
5,042,444 A 8/1991 Hayes et al.
5,094,213 A 3/1992 Dudek et al.
5,226,513 A 7/1993 Shibayama
5,278,760 A * 1/1994 Ribbens ..... F02D 41/1498 123/436
5,357,932 A 10/1994 Clinton et al.
5,374,224 A 12/1994 Huffmaster et al.
5,377,631 A 1/1995 Schechter
5,423,208 A 6/1995 Dudek et al.
5,465,617 A 11/1995 Dudek et al.
5,553,575 A 9/1996 Beck et al.
5,584,266 A 12/1996 Motose et al.
5,669,354 A * 9/1997 Morris ..... F02D 41/1498 123/406.24
5,692,471 A 12/1997 Zhang
5,720,257 A 2/1998 Motose et al.
5,884,605 A 3/1999 Nagaishi et al.
5,909,720 A 6/1999 Yamaoka et al.
5,975,052 A 11/1999 Moyer
6,158,411 A 12/2000 Morikawa
6,244,242 B1 6/2001 Grizzle et al.
6,247,449 B1 6/2001 Persson
6,360,724 B1 3/2002 Suhre et al.
6,385,521 B1 * 5/2002 Ito ..... B60W 10/06 477/34
6,546,912 B2 * 4/2003 Tuken ..... F02D 41/0085 123/436
6,619,258 B2 9/2003 McKay et al.
6,760,656 B2 7/2004 Matthews et al.
6,978,204 B2 12/2005 Surnilla et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,069,718 B2 7/2006 Surnilla et al.
7,086,386 B2 8/2006 Doering
7,100,720 B2 9/2006 Ishikawa
7,111,612 B2 9/2006 Michelini et al.
7,140,355 B2 11/2006 Michelini et al.
7,174,879 B1 2/2007 Chol et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,464,676 B2 12/2008 Wiggins et al.
7,497,074 B2 3/2009 Surnilla et al.
7,499,791 B2 3/2009 You et al.
7,503,312 B2 3/2009 Surnilla et al.
7,509,201 B2 3/2009 Bolander et al.
7,577,511 B1 8/2009 Tripathi et al.
7,685,976 B2 3/2010 Marriott
7,785,230 B2 8/2010 Gibson et al.
7,836,866 B2 11/2010 Luken et al.
7,849,835 B2 12/2010 Tripathi et al.
7,886,715 B2 2/2011 Tripathi et al.
7,930,087 B2 4/2011 Gibson et al.
7,954,474 B2 6/2011 Tripathi et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 * 4/2012 Leone ..... F02D 41/0087 123/198 F
8,272,367 B2 9/2012 Shikama et al.
8,473,179 B2 6/2013 Whitney et al.
8,616,181 B2 12/2013 Sahandiesfanjani et al.
8,646,430 B2 2/2014 Kinoshita
8,646,435 B2 2/2014 Dibble et al.
8,701,628 B2 4/2014 Tripathi et al.
8,833,058 B2 9/2014 Ervin et al.
8,833,345 B2 9/2014 Pochner et al.
2002/0162540 A1 11/2002 Matthews et al.
2003/0116130 A1 6/2003 Kisaka et al.
2003/0123467 A1 7/2003 Du et al.
2003/0131820 A1 7/2003 Mckay et al.
2003/0172900 A1 9/2003 Boyer et al.
2004/0206072 A1 10/2004 Surnilla et al.
2005/0016492 A1 1/2005 Matthews
2005/0131618 A1 6/2005 Megli et al.
2005/0197761 A1 9/2005 Bidner et al.
2005/0199220 A1 9/2005 Ogiso
2005/0204726 A1 9/2005 Lewis
2005/0204727 A1 9/2005 Lewis et al.
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 5/2006 Nishi et al.
2007/0042861 A1 2/2007 Takaoka et al.
2007/0107692 A1 5/2007 Kuo et al.
2007/0131196 A1 6/2007 Gibson et al.
2007/0235005 A1 10/2007 Lewis
2008/0066699 A1 3/2008 Michelini et al.
2008/0154468 A1 6/2008 Berger et al.
2008/0288146 A1 * 11/2008 Beechie ..... B60W 10/023 701/58
2009/0007877 A1 1/2009 Raiford
2009/0030594 A1 1/2009 You et al.
2009/0042458 A1 2/2009 Kinoshita
2009/0118975 A1 5/2009 Murakami et al.
2009/0177371 A1 7/2009 Reinke
2009/0248277 A1 10/2009 Shinagawa et al.
2009/0248278 A1 10/2009 Nakasaka
2010/0006065 A1 1/2010 Tripathi et al.
2010/0010724 A1 1/2010 Tripathi et al.
2010/0012072 A1 1/2010 Leone et al.
2010/0050993 A1 3/2010 Zhao et al.
2010/0059004 A1 3/2010 Gill
2010/0100299 A1 * 4/2010 Tripathi ..... F02D 41/0087 701/102
2010/0211299 A1 8/2010 Lewis et al.
2011/0030657 A1 2/2011 Tripathi et al.
2011/0048372 A1 3/2011 Dibble et al.
2011/0107986 A1 5/2011 Winstead
2011/0144883 A1 6/2011 Rollinger et al.
2011/0208405 A1 8/2011 Tripathi et al.
2011/0213540 A1 9/2011 Tripathi et al.
2011/0213541 A1 9/2011 Tripathi et al.
2011/0251773 A1 10/2011 Sahandiesfanjani et al.
2012/0055444 A1 3/2012 Tobergte et al.
2012/0109495 A1 5/2012 Tripathi et al.
2012/0116647 A1 5/2012 Pochner et al.
2012/0143471 A1 6/2012 Tripathi et al.
2012/0221217 A1 8/2012 Sujan et al.
2012/0285161 A1 11/2012 Kerns et al.
2013/0092127 A1 4/2013 Pirjaberi et al.
2013/0092128 A1 4/2013 Pirjaberi et al.
2013/0289853 A1 10/2013 Serrano
2014/0041625 A1 2/2014 Pirjaberi et al.
2014/0053802 A1 2/2014 Rayl
2014/0053804 A1 2/2014 Rayl et al.
2014/0053805 A1 2/2014 Brennan et al.
2014/0069178 A1 3/2014 Beikmann
2014/0069378 A1 3/2014 Burleigh et al.
2014/0069379 A1 3/2014 Beikmann
2014/0069381 A1 3/2014 Beikmann

(56) References Cited

U.S. PATENT DOCUMENTS

| | | | |
|---|---|---|---|
| 2014/0090623 | A1 | 4/2014 | Beikmann |
| 2014/0090624 | A1 | 4/2014 | Verner |
| 2014/0102411 | A1 | 4/2014 | Brennan |

OTHER PUBLICATIONS

U.S. Appl. No. 61/952,737, filed Mar. 13, 2014, Shost et al.
U.S. Appl. No. 13/798,451, filed Mar. 13, 2013, Rayl.
U.S. Appl. No. 13/798,351, filed Mar. 13, 2013, Rayl.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,536, filed Mar. 13, 2013, Matthews et al.
U.S. Appl. No. 13/798,435, filed Mar. 13, 2013, Matthews.
U.S. Appl. No. 13/798,471, filed Mar. 13, 2013, Matthews et al.
U.S. Appl. No. 13/798,737, filed Mar. 13, 2013, Beikmann.
U.S. Appl. No. 13/798,701, filed Mar. 13, 2013, Burleigh et al.
U.S. Appl. No. 13/798,518, filed Mar. 13, 2013, Beikmann.
U.S. Appl. No. 13/799,129, filed Mar. 13, 2013, Beikmann.
U.S. Appl. No. 13/798,540, filed Mar. 13, 2013, Brennan et al.
U.S. Appl. No. 13/799,181, filed Mar. 13, 2013, Verner.
U.S. Appl. No. 13/799,116, filed Mar. 13, 2013, Brennan.
U.S. Appl. No. 13/798,624, filed Mar. 13, 2013, Brennan et al.
U.S. Appl. No. 13/798,384, filed Mar. 13, 2013, Burtch.
U.S. Appl. No. 13/798,775, filed Mar. 13, 2013, Phillips.
U.S. Appl. No. 13/798,400, filed Mar. 13, 2013, Phillips.
U.S. Appl. No. 14/211,389, filed Mar. 14, 2014, Liu et al.
U.S. Appl. No. 14/310,063, filed Jun. 20, 2014, Wagh et al.
U.S. Appl. No. 14/300,469, filed Jun. 10, 2014, Li et al.
U.S. Appl. No. 14/449,726, filed Aug. 1, 2014, Hayman et al.
U.S. Appl. No. 14/734,619, filed Jun. 9, 2015, Matthews.
International Search Report and Written Opinion dated Jun. 17, 2015 corresponding to International Application No. PCT/US2015/019496, 14 pages.

* cited by examiner

SYSTEM AND METHOD FOR CONTROLLING A FIRING SEQUENCE OF AN ENGINE TO REDUCE VIBRATION WHEN CYLINDERS OF THE ENGINE ARE DEACTIVATED

CROSS-REFERENCE TO RELATED APPLICATIONS

This application claims the benefit of U.S. Provisional Application No. 61/709,181, filed on Oct. 3, 2012. The disclosure of the above application is incorporated herein by reference in its entirety.

This application is related to U.S. patent application Ser. No. 13/798,451 filed on Mar. 13, 2013, Ser. No. 13/798,351 filed on Mar. 13, 2013, Ser. No. 13/798,586 filed on Mar. 13, 2013, Ser. No. 13/798,590 filed on Mar. 13, 2013, Ser. No. 13/798,536 filed on Mar. 13, 2013, Ser. No. 13/798,435 filed on Mar. 13, 2013, Ser. No. 13/798,471 filed on Mar. 13, 2013, Ser. No. 13/798,737 filed on Mar. 13, 2013, Ser. No. 13/798,701 filed on Mar. 13, 2013, Ser. No. 13/798,518 filed on Mar. 13, 2013, Ser. No. 13/799,129 filed on Mar. 13, 2013, Ser. No. 13/798,540 filed on Mar. 13, 2013, Ser. No. 13/799,181 filed on Mar. 13, 2013, Ser. No. 13/799,116 filed on Mar. 13, 2013, Ser. No. 13/798,624 filed on Mar. 13, 2013, Ser. No. 13/798,384 filed on Mar. 13, 2013, Ser. No. 13/798,775 filed on Mar. 13, 2013, and Ser. No. 13/798,400 filed on Mar. 13, 2013. The entire disclosures of the above applications are incorporated herein by reference.

FIELD

The present disclosure relates to systems and methods for controlling a firing sequence of an engine to reduce vibration when cylinders of the engine are deactivated.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Under some circumstances, one or more cylinders of an engine may be deactivated to decrease fuel consumption. For example, one or more cylinders may be deactivated when the engine can produce a requested amount of torque while the one or more cylinders are deactivated. Deactivation of a cylinder may include disabling opening of intake and exhaust valves of the cylinder and disabling fueling of the cylinder.

SUMMARY

A system according to the present disclosure includes a spectral density module and a firing sequence module. The spectral density module determines a spectral density of engine speed. The firing sequence module selects a first set of M cylinders of an engine to activate, selects a second set of N cylinders of the engine to deactivate, and selects a firing sequence to activate the first set of M cylinders and to deactivate the second set of N cylinders. M and N are integers greater than or equal to one. The firing sequence specifies whether each cylinder of the engine is active or deactivated. Based on the spectral density, the firing sequence module adjusts the firing sequence to adjust M and N and/or to adjust which cylinders of the engine are included in the first set and which cylinders of the engine are included in the second set.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
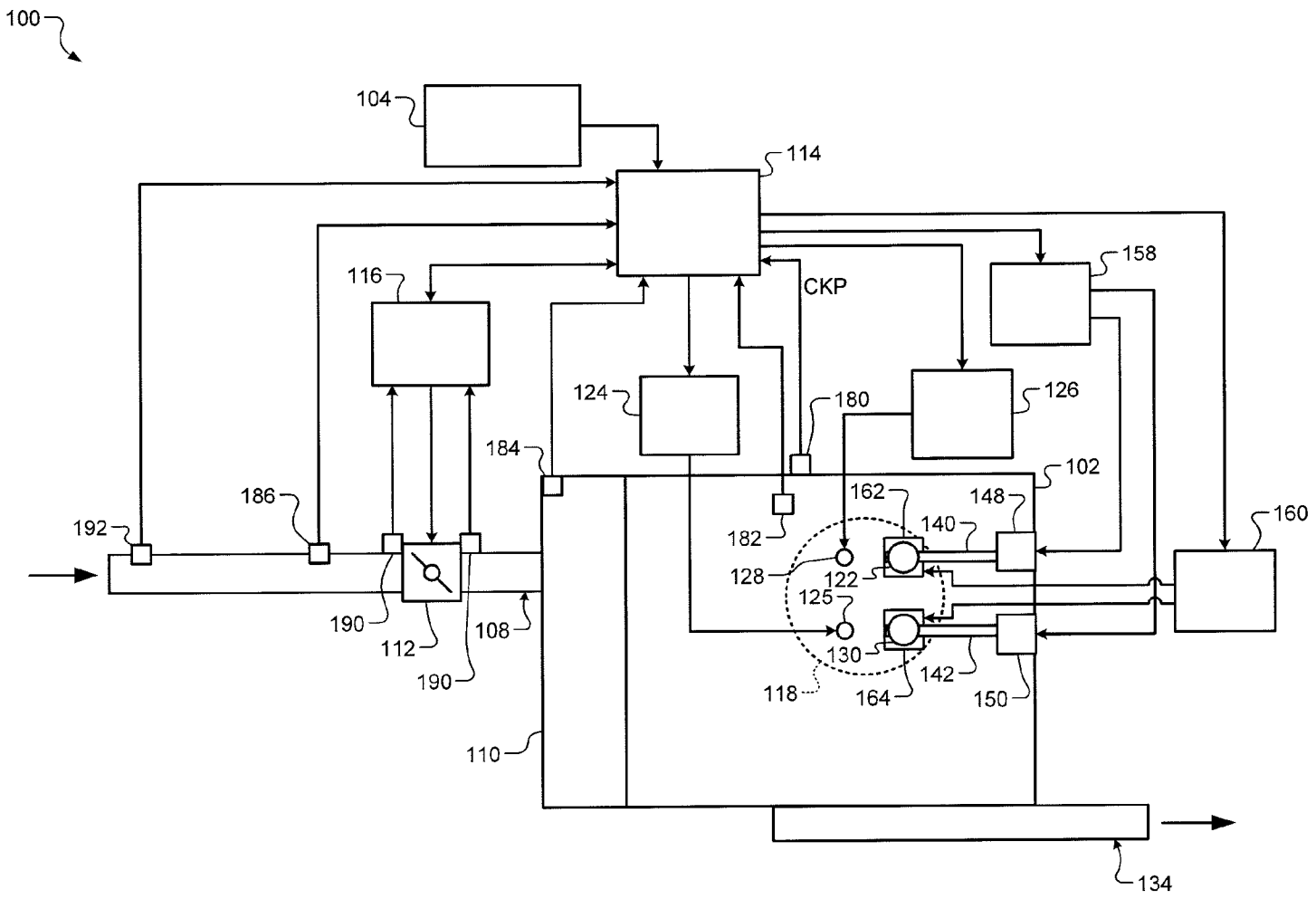
FIG. 1 is a functional block diagram of an example engine system according to the principles of the present disclosure.

When cylinders of an engine are deactivated, a firing sequence of the engine may be adjusted to achieve a desired number of deactivated cylinders and/or to change which cylinders are deactivated. The firing sequence may be adjusted without regard to the noise and vibration performance of a vehicle. Thus, a driver may perceive an increase in the noise and vibration of a vehicle when cylinders are deactivated.

A firing sequence may have an alternating pattern, a consecutive pattern, or a mixed pattern that includes both alternating and consecutive portion. A firing sequence having an alternating pattern alternates between a firing cylinder and a non-firing cylinder as the firing sequence progresses according to a firing order of the engine. For example, for a four-cylinder engine, a firing sequence having an alternating pattern may be 0-1-0-1, where 1 indicates a firing cylinder and 0 indicates a non-firing cylinder.

A firing sequence having a consecutive pattern includes consecutive firing cylinders and/or consecutive non-firing cylinders as the firing sequence progresses according to a firing order of the engine. For example, for a four-cylinder engine, a firing sequence having a consecutive pattern may be 1-0-0-1, where 1 indicates a firing cylinder and 0 indicates a non-firing cylinder. For an eight-cylinder engine, an example firing sequence having a mixed pattern may be 0-1-0-1-1-0-0-1, where 1 indicates a firing cylinder and 0 indicates a non-firing cylinder.

A system and method according to the principles of the present disclosure adjusts a firing sequence of an engine based on a spectral density of engine speed to reduce noise and vibration when cylinders are deactivated. The firing sequence may be adjusted to adjust which cylinders are deactivated and/or the number of deactivated cylinders. In one example, the spectral density is an energy spectral density representing an amount of energy associated with crankshaft movement with respect to an inverse of the engine speed. In another example, the spectral density is a power spectral density representing an amount of power associated with crankshaft movement with respect to the engine speed inverse. In either example, the amount of noise and vibration generated by the engine is directly proportional to the spectral density.

To reduce engine vibration, the firing sequence may be adjusted when the spectral density is greater than a first threshold (e.g., a first predetermined value). In one example, the number of deactivated cylinders is decreased when the spectral density is greater than the first threshold. In another example, the firing sequence, or a portion of the firing sequence, is switched between an alternating pattern and a consecutive pattern when the spectral density is greater than the first threshold.

To improve fuel economy while reducing engine vibration, the number of deactivated cylinders may be increased when the engine can satisfy the driver torque request at the increased number of deactivated cylinders. The number of deactivated cylinders may be increased when the spectral density is greater than the first threshold. Additionally or alternatively, the number of deactivated cylinders may be increased when the spectral density is less than a second threshold (e.g., a second predetermined value). The second threshold is less than the first threshold.

Referring now to FIG. 1, an engine system 100 includes an engine 102 that combusts an air/fuel mixture to produce drive torque for a vehicle. The amount of drive torque produced by the engine 102 is based on driver input from a driver input module 104. Air is drawn into the engine 102 through an intake system 108. The intake system 108 includes an intake manifold 110 and a throttle valve 112. The throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. For illustration purposes, a single representative cylinder 118 is shown. However, the engine 102 may include multiple cylinders. For example, the engine 102 may include 2, 3, 4, 5, 6, 8, 10, and/or 12 cylinders. The ECM 114 may deactivate one or more of the cylinders, which may improve fuel economy under certain engine operating conditions.

The engine 102 may operate using a four-stroke cycle. The four strokes include an intake stroke, a compression stroke, a combustion stroke, and an exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates a fuel injector 125 to control the amount of fuel provided to the cylinder to achieve a desired air/fuel ratio. The fuel injector 125 may inject fuel directly into the cylinder 118 or into a mixing chamber associated with the cylinder 118. The fuel actuator module 124 may halt fuel injection into cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114. The spark ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. A firing event causes combustion in a cylinder when an air/fuel mixture is provided to the cylinder (e.g., when the cylinder is active). The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. As the combustion of the air/fuel mixture drives the piston down, the piston moves from TDC to its bottom-most position, referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. The ECM 114 may disable opening of the intake and exhaust valves 122, 130 of cylinders that are deactivated. A phaser actuator module 158 may control the intake cam phaser 148 and the exhaust cam phaser 150 based on signals from the ECM 114. When implemented, variable valve lift (not shown) may also be controlled by the phaser actuator module 158.

The ECM 114 may deactivate the cylinder 118 by instructing a valve actuator module 160 to deactivate opening of the intake valve 122 and/or the exhaust valve 130. The valve actuator module 160 controls an intake valve actuator 162 that opens and closes the intake valve 122. The valve actuator module 160 controls an exhaust valve actuator 164 that opens and closes the exhaust valve 130. In one example, the valve actuators 162, 164 include solenoids that deactivate opening of the valves 122, 130 by decoupling cam followers from the camshafts 140, 142. In another example, the valve actuators 162, 164 are electromagnetic or electrohydraulic actuators that control the lift, timing, and duration of the valves 122, 130 independent from the camshafts 140, 142. In this example, the camshafts 140, 142, the cam phasers 148, 150, and the phaser actuator module 158 may be omitted.

The position of the crankshaft may be measured using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

Figure 2:
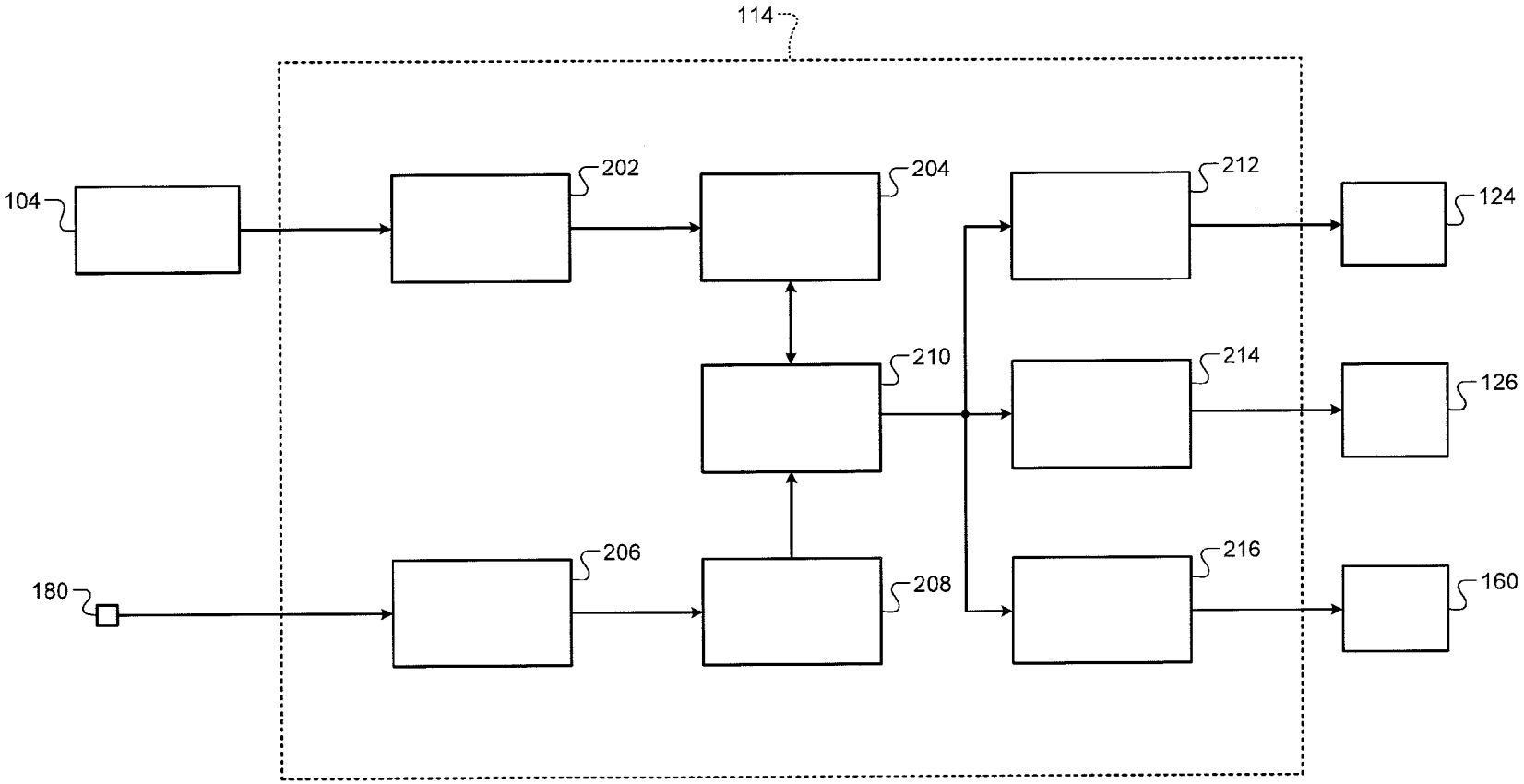
FIG. 2 is a functional block diagram of an example control system according to the principles of the present disclosure.

Referring now to FIG. 2, an example implementation of the ECM 114 includes a torque request module 202, a cylinder deactivation module 204, an engine speed module 206, a spectral density module 208, and a firing sequence module 210. The torque request module 202 determines a driver torque request based on the driver input from the driver input module 104. The driver input may be based on a position of an accelerator pedal. The driver input may also be based on an input from a cruise control system, which may be an adaptive cruise control system that varies vehicle speed to maintain a predetermined following distance. The torque request module 202 may store one or more mappings of accelerator pedal position to desired torque, and may determine the driver torque request based on a selected one of the mappings. The torque request module 202 outputs the driver torque request.

The cylinder deactivation module 204 deactivates cylinders in the engine 102 based on the driver torque request. The cylinder deactivation module 204 may deactivate one or more cylinders when the engine 102 can satisfy the driver torque request while the cylinders are deactivated. The cylinder deactivation module 204 may reactivate the cylinders when the engine 102 cannot satisfy the driver torque request while the cylinders are deactivated. The cylinder deactivation module 204 outputs the quantity of deactivated cylinders.

The engine speed module 206 determines engine speed based on input received from the CKP sensor 180. The CKP sensor 180 may include a Hall effect sensor, an optical sensor, an inductor sensor, and/or another suitable type of sensor positioned adjacent to a disk having N teeth (e.g., 58 teeth). The disk may rotate with the crankshaft while the sensor remains stationary. The sensor may detect when the teeth pass by the sensor. The engine speed module 206 may determine the engine speed based on an amount of crankshaft rotation between tooth detections and the corresponding period.

The CKP sensor 180 may measure the crankshaft position and the engine speed module 206 may determine the engine speed at a predetermined increment of crankshaft rotation. The predetermined increment may correspond to the amount of crankshaft rotation between tooth detections. In one example, the CKP sensor 180 measures the crankshaft position and the engine speed module 206 determines the engine speed every six degrees of crankshaft rotation. In this example, the engine speed module 206 generates 120 samples of the engine speed during an engine cycle corresponding to 720 degrees of crankshaft rotation. The engine speed module 206 outputs the engine speed.

The spectral density module 208 determines a spectral density of the engine speed using, for example, a fast Fourier transform. In one example, the spectral density is an energy spectral density representing an amount of energy associated with crankshaft movement with respect to an inverse of the engine speed. In another example, the spectral density is a power spectral density representing an amount of power associated with crankshaft movement with respect to the engine speed inverse. In either example, the spectral density is directly proportional to the amount of vibration generated by the engine 102. The spectral density module 208 may determine the spectral density of each engine cycle (e.g., for every 720 degrees of crankshaft rotation). The spectral density module 208 outputs the spectral density.

The firing sequence module 210 determines a firing sequence of the cylinders in the engine 102. The firing sequence specifies whether the cylinders are active (i.e., firing) or deactivated (i.e., non-firing). The firing sequence may correspond to an engine cycle (e.g., 720 degrees of crankshaft rotation) and may include a number of cylinder events equal to the number of cylinders in the engine 102. A cylinder event may refer to a firing event and/or a crank angle increment during which spark is generated in a cylinder when the cylinder is active. The firing sequence may progress according to a firing order of the engine. The firing sequence module 210 outputs the firing sequence.

The firing sequence module 210 may assess and/or adjust the firing sequence after each engine cycle and/or at the end of each firing sequence. The firing sequence module 210 may change the firing sequence from one engine cycle to the next engine cycle to change the quantity of active cylinders without changing the order in which cylinders are firing. For example, for an eight-cylinder engine having a firing order of 1-8-7-2-6-5-4-3, a firing sequence of 1-8-7-2-5-3 may be specified for one engine cycle, and a firing sequence of 1-7-2-5-3 may be specified for the next engine cycle. This decreases the quantity of active cylinders from 6 to 5.

The firing sequence module 210 may change the quantity of active cylinders from one engine cycle to the next engine cycle based on instructions received from the cylinder deactivation module 204. The cylinder deactivation module 204 may alternate the quantity of active cylinders between two integers to achieve an effective cylinder count that is equal to the average value of the two integers. For example, the cylinder deactivation module 204 may alternate the quantity of active cylinders between 5 and 6, resulting in an effective cylinder count of 5.5.

The firing sequence module 210 may change the firing sequence from one engine cycle to the next engine cycle to change which cylinders are firing, and thereby change which cylinders are active, without changing the quantity of active cylinders. For example, when three cylinders of the eight-cylinder engine described above are deactivated, a firing sequence of 1-7-2-5-3 may be specified for one engine cycle, and a firing sequence of 8-2-6-4-3 may be specified for the next engine cycle. This deactivates cylinders 1, 7, and 5 and reactivates cylinders 8, 6, and 4.

The firing sequence module 210 may adjust the firing sequence to have an alternating pattern, a consecutive pattern, or a mixed pattern that includes both alternating and consecutive portions. A firing sequence having an alternating pattern alternates between a firing cylinder and a non-firing cylinder as the firing sequence progresses according to a firing order of the engine. For example, for a four-cylinder engine, a firing sequence having an alternating pattern may be 0-1-0-1, where 1 indicates a firing cylinder and 0 indicates a non-firing cylinder.

A firing sequence having a consecutive pattern includes consecutive firing cylinders and/or consecutive non-firing cylinders. For example, for a four-cylinder engine, a firing sequence having a consecutive pattern may be 1-0-0-1, where 1 indicates a firing cylinder and 0 indicates a non-firing cylinder. For an eight-cylinder engine, an example firing sequence having a mixed pattern may be 0-1-0-1-1-0-0-1, where 1 indicates a firing cylinder and 0 indicates a non-firing cylinder.

The firing sequence module 210 adjusts which cylinders are deactivated and/or the number of deactivated cylinders based on the spectral density. The firing sequence module 210 may adjust which cylinders are deactivated and/or decrease the number of deactivated cylinders (e.g., reactivate a cylinder) when the spectral density is greater than a first threshold. The firing sequence module may adjust which cylinders are deactivated by switching the firing sequence, or portions of the firing sequence, between an alternating pattern and a consecutive pattern.

The firing sequence module 210 may adjust the firing sequence to a mixed pattern that includes both alternating and consecutive portions, as discussed above, and each portion may be referred to as a firing sequence. In addition, the firing sequence module 210 may alternate the firing sequence between the alternating pattern and a consecutive pattern from one engine cycle to the next engine cycle. In either case, the spectral density module 208 may determine a first spectral density of the alternating sequence and a second spectral density of the consecutive sequence.

If the first spectral density is greater than the first threshold and the second spectral density is less than the first threshold, the spectral density module 208 may adjust the alternating sequence to a consecutive sequence. If the first spectral density is less than the first threshold and the second spectral density is greater than the first threshold, the firing sequence module 210 may adjust the consecutive sequence to an alternating sequence. If the first spectral density and the second spectral density are both greater than the first threshold, the firing sequence module 210 may adjust the number of deactivated cylinders.

The firing sequence module 210 may increase the number of deactivated cylinders when the engine 102 can satisfy the driver torque request at the increased number of deactivated cylinders. In one example, before increasing the number of deactivated cylinders, the firing sequence module 210 outputs an increased number of deactivated cylinders to the cylinder deactivation module 204. The cylinder deactivation module 204 then determines whether the engine 102 can satisfy the driver torque request at the increased number of deactivated cylinders and outputs the determination to the firing sequence module 210.

The firing sequence module 210 may increase the number of deactivated cylinders when the spectral density is greater than the first threshold and the engine 102 can satisfy the driver torque request at the increased number of deactivated cylinders. The number of deactivated cylinders may be increased on a temporary basis to determine whether increasing the number of deactivated cylinders decreases the spectral density to less than the first threshold. If this is the case, the number of deactivated cylinders may be maintained at the increased level.

The firing sequence module 210 may increase the number of deactivated cylinders when the spectral density is less than a second threshold and the engine 102 can satisfy the driver torque request at the increased number of deactivated cylinders. The second threshold is less than the first threshold. The firing sequence module 210 outputs the firing sequence to a fuel control module 212, a spark control module 214, and a valve control module 216.

The fuel control module 212 instructs the fuel actuator module 124 to provide fuel to cylinders of the engine 102 according to the firing sequence. The spark control module 214 instructs the spark actuator module 126 to generate spark in cylinders of the engine 102 according to the firing sequence. The spark control module 214 may output a signal indicating which of the cylinders is next in the firing sequence. The valve control module 216 instructs the valve actuator module 160 to open intake and exhaust valves of the engine 102 according to the firing sequence.

Figure 3:
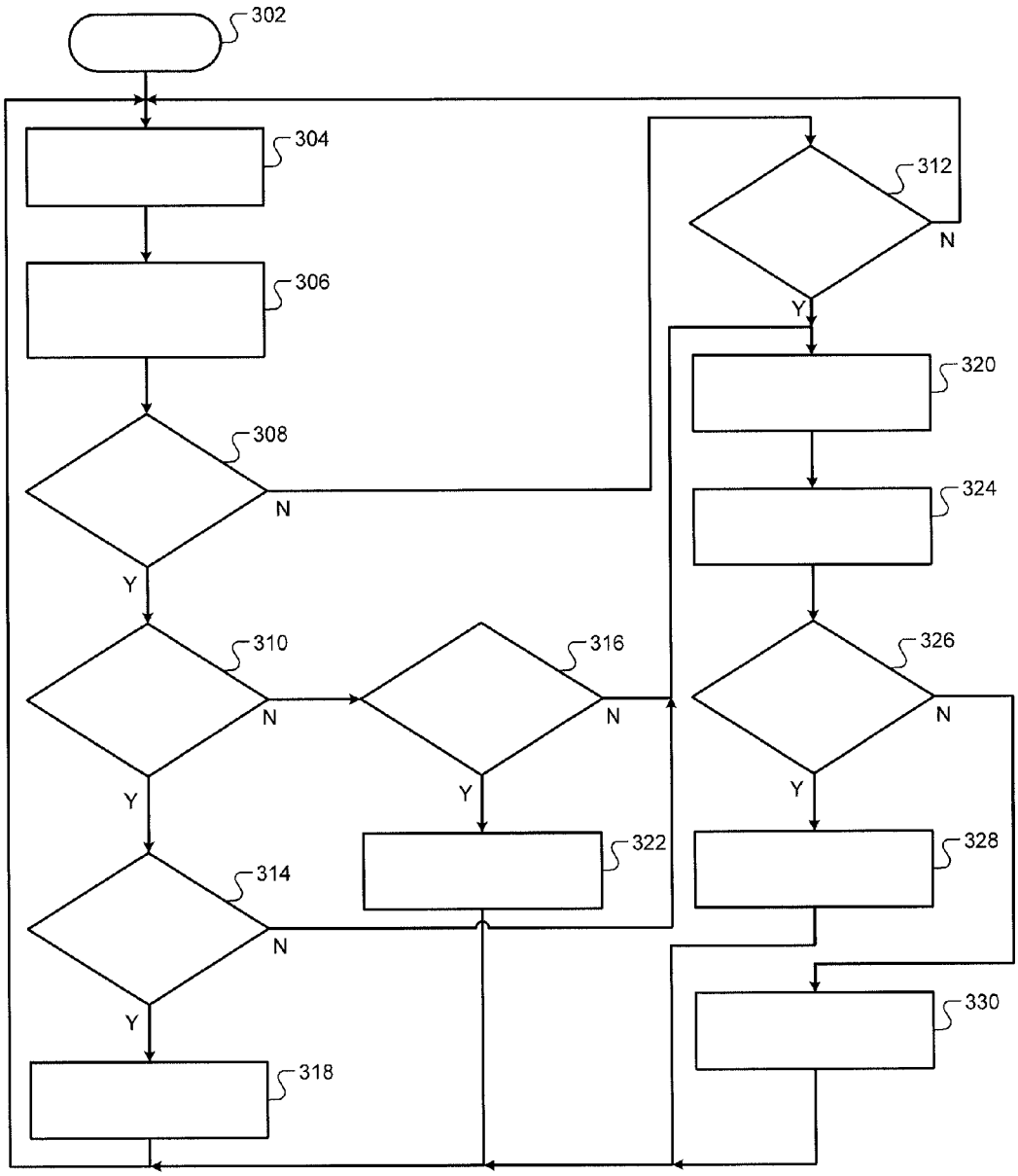
FIG. 3 is a flowchart illustrating an example control method according to the principles of the present disclosure.

Referring now to FIG. 3, a method for controlling a firing sequence of an engine to reduce vibration when cylinders of the engine are deactivated begins at 302. At 304, the method determines engine speed based on a measured crankshaft position. The method may determine the engine speed at a predetermined increment (e.g., 6 degrees) of crankshaft rotation. Thus, for an engine cycle corresponding to 720 degrees of crankshaft rotation, the method may generate 120 samples of engine speed.

At 306, the method determines an energy spectral density (ESD) of the engine speed, using for example, a fast Fourier transform. The method may adjust the firing sequence of the engine and/or a number of deactivated cylinders in the engine based on the energy spectral density. Additionally or alternatively, the method may determine a power spectral density of the engine speed and adjust the firing sequence and/or the number of deactivated cylinders based on the power spectral density.

At 308, the method determines whether the energy spectral density is greater than a first threshold. If the energy spectral density is greater than the first threshold, the method continues at 310. Otherwise, the method continues at 312. At 310, the method determines whether the firing sequence corresponding to the energy spectral density has an alternating pattern. If the firing sequence has an alternating pattern, the method continues at 314. Otherwise, the method continues at 316.

At 314, the method determines whether the energy spectral density of a consecutive sequence is less than the first threshold. The consecutive sequence may be one portion of a firing sequence and the alternating sequence corresponding to the energy spectral density may be another portion of the firing sequence. Alternatively, the method may alternate between the alternating sequence and the consecutive sequence from one engine cycle to the next engine cycle.

If the energy spectral density of the consecutive sequence is less than the first threshold, the method continues at 318. Otherwise, the method continues at 312. At 318, the method adjusts the alternating sequence to a consecutive sequence.

At 316, the method determines whether the energy spectral density of an alternating sequence is less than the first threshold. The alternating sequence may be one portion of a firing sequence and the consecutive sequence corresponding to the energy spectral density may be another portion of the firing sequence. Alternatively, the method may alternate between the alternating sequence and the consecutive sequence from one engine cycle to the next engine cycle.

If the energy spectral density of the alternating sequence is less than the first threshold, the method continues at 322. Otherwise, the method continues at 312. At 322, the method adjusts the consecutive sequence to an alternating sequence.

At 312, the method determines whether the energy spectral density is less than a second threshold. If the energy spectral density is less than the second threshold, the method continues at 320. Otherwise, the method continues at 304.

At 320, the method determines a driver torque request. The method determines the driver torque request based on the position of an accelerator pedal and/or based on an input from a cruise control system, which may be an adaptive cruise control system that varies vehicle speed to maintain a predetermined following distance. At 324, the method predicts a torque output of the engine for an increased number of deactivated cylinders (e.g., the number of cylinders currently deactivated plus one).

At 326, the method determines whether the predicted torque output is greater than the driver torque request. If the predicted torque output is greater than the driver torque request, the method continues at 328. Otherwise, the method continues at 330.

At 328, the method increases the number of deactivated cylinders to the number of deactivated cylinders corresponding to the predicted torque output. At 330, the method decreases the number of deactivated cylinders. In various implementations, the method may refrain from decreasing the number of deactivated cylinders when the energy spectral density is less than the second threshold.

Figure 4:
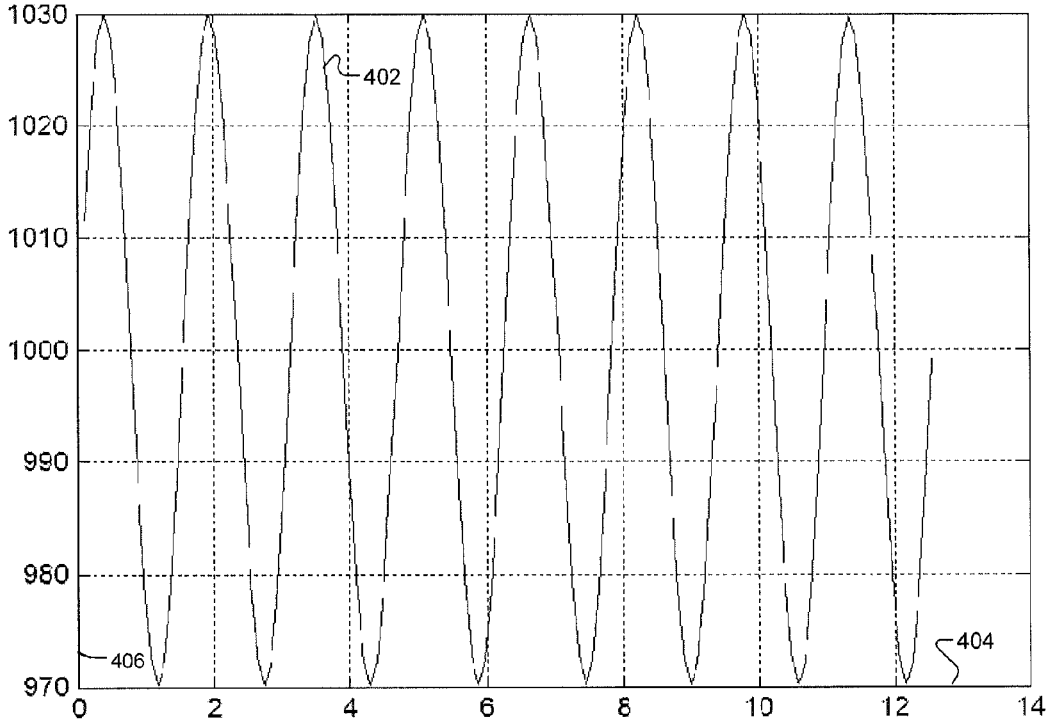
FIGS. 4 through 9 are line graphs illustrating engine speed with respect to crank angle and a corresponding energy spectral density.

Referring now to FIG. 4, engine speed 402 of an eight-cylinder engine with all cylinders firing is plotted with respect to an x-axis 404 and a y-axis 406. The x-axis 404 represents crank angle, in radians (rad), where a crank angle of 0 radians may correspond to approximately 90 degrees of crankshaft rotation after top dead center. The y-axis 406 represents engine speed in revolutions per minute (RPM). The engine speed 402 is a continuous sinusoid that increases after each cylinder fires and decreases between firing events as gas within the cylinders is compressed.

Figure 5:
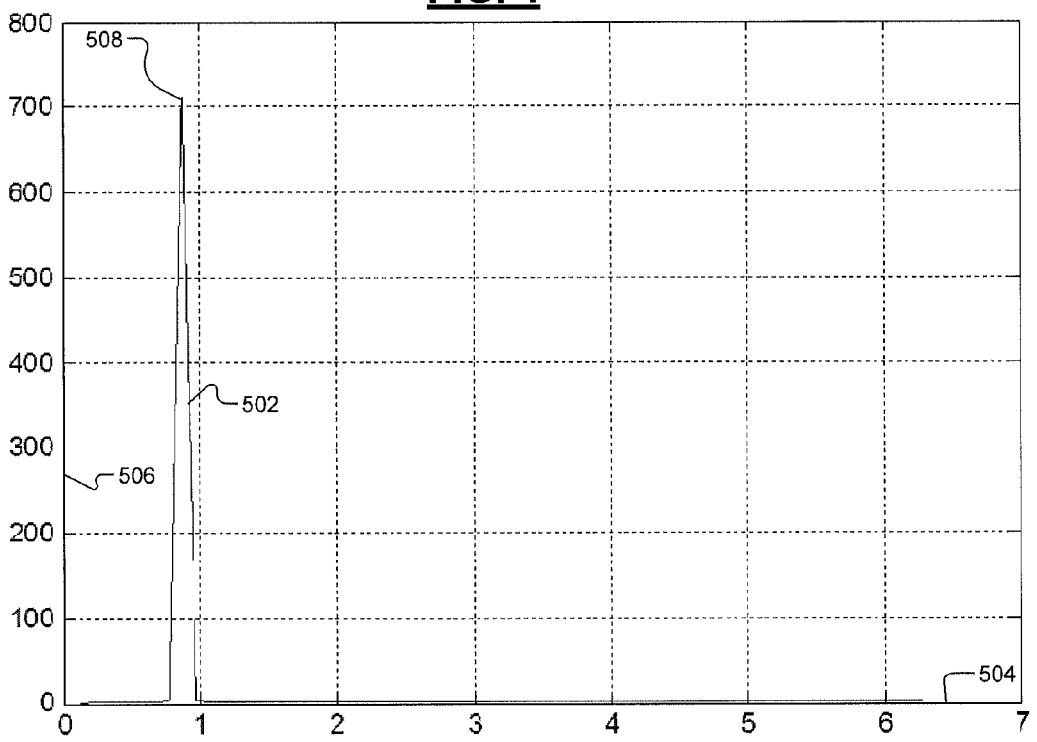

Referring now to FIG. 5, an energy spectral density 502 of the engine speed 402 between 0.098 radians and 6.28 radians is plotted with respect to an x-axis 504 and a y-axis 506. The x-axis 504 represents an inverse of the crank angle in 1/rad and is proportional to frequency in hertz (Hz). The y-axis 506 represents energy per crank angle inverse and is proportional to energy per frequency in Joules per hertz (J/Hz). For discussion purposes, the units of the y-axis 506 will be referred to as energy units. Since the engine speed 402 increases and decreases at a constant frequency and magnitude, the energy spectral density 502 includes a single peak at 508 with a relatively low magnitude of approximately 700 energy units.

Figure 6:
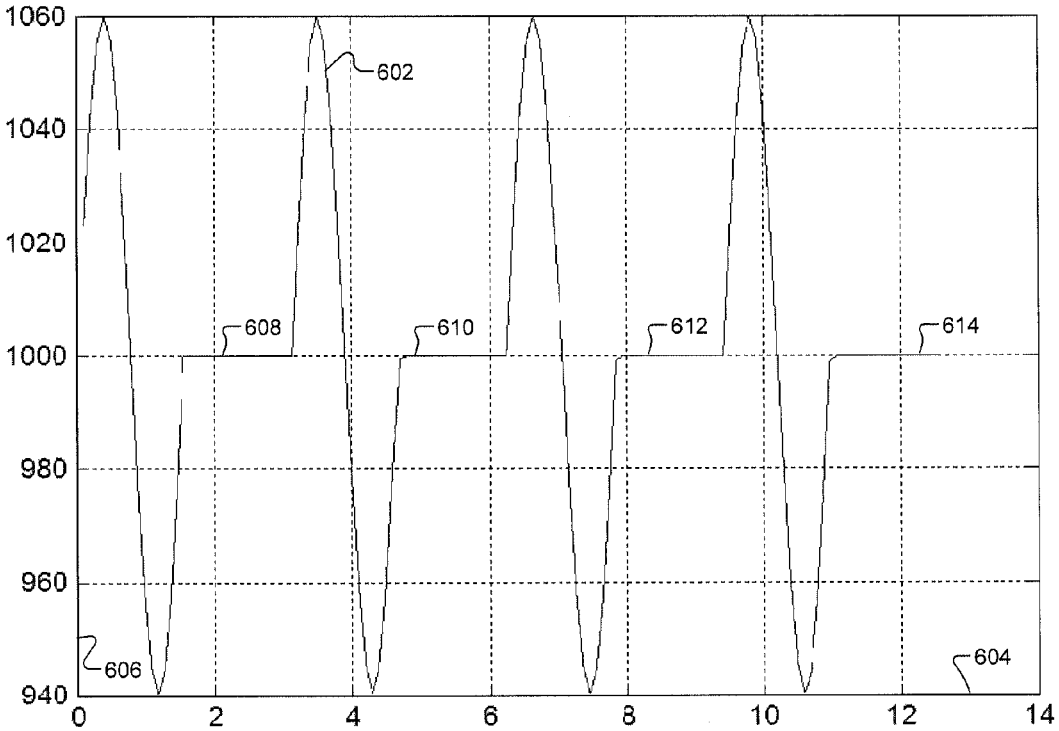

Referring now to FIG. 6, engine speed 602 of an eight-cylinder engine with every other cylinder in a firing order (i.e., an alternating pattern) is plotted with respect to an x-axis 604 and a y-axis 606. The x-axis 604 represents crank angle, in rad, where a crank angle of 0 radians may correspond to approximately 90 degrees of crankshaft rotation after top dead center. The y-axis 606 represents engine speed in RPM. The engine speed 602 is generally sinusoidal with interruptions in the sinusoidal pattern, or flat portions, occurring at 608, 610, 612, and 614. The flat portions 608, 610, 612, and 614 correspond to the non-firing cylinders.

Figure 7:
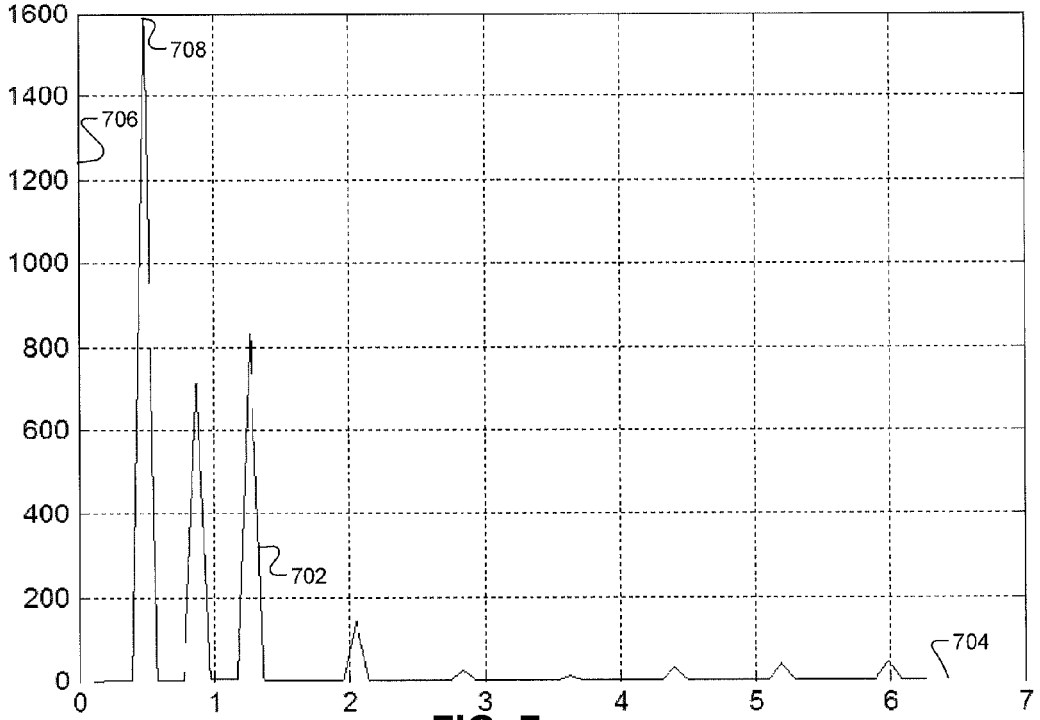

Referring now to FIG. 7, an energy spectral density 702 of the engine speed 602 is plotted with respect to an x-axis 704 and a y-axis 706. The x-axis 704 represents an inverse of the crank angle in 1/rad and is proportional to frequency in Hz. The y-axis 706 represents energy per crank angle inverse and is proportional to energy per frequency in J/Hz. For discussion purposes, the units of the y-axis 706 will be referred to as energy units. Since the engine speed 602 fluctuates due to the non-firing cylinders, the energy spectral density 702 includes multiple peaks with a peak at 708 having a relatively high magnitude of approximately 1600 energy units.

Figure 8:
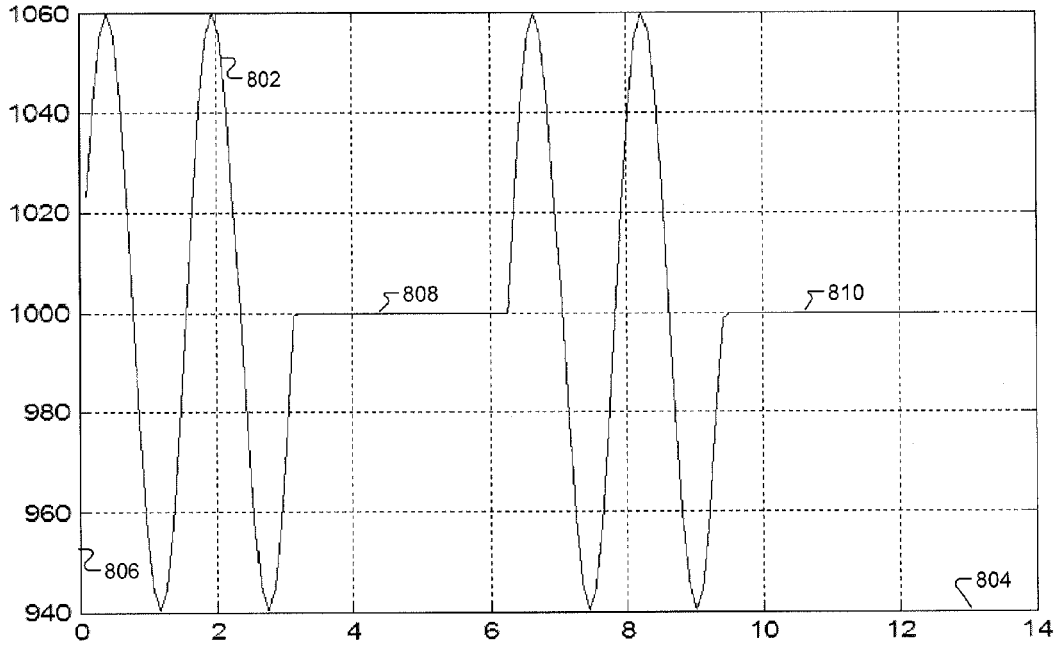

Referring now to FIG. 8, engine speed 802 of an eight-cylinder engine with two consecutive cylinders in a firing order firing and two consecutive cylinders in a firing order not firing (i.e., a consecutive pattern) is plotted with respect to an x-axis 804 and a y-axis 806. The x-axis 804 represents crank angle, in rad, where a crank angle of 0 radians may correspond to approximately 90 degrees of crankshaft rotation after top dead center. The y-axis 806 represents engine speed in RPM. The engine speed 802 is generally sinusoidal with interruptions in the sinusoidal pattern, or flat portions, occurring at 808 and 810. The flat portions 808 and 810 correspond to the non-firing cylinders and have a longer duration in terms of crankshaft rotation relative to the flat portions 608, 610, 612, and 614 in the engine speed 602. The longer duration is due to the fact that two consecutive cylinders are not firing instead of one.

Figure 9:
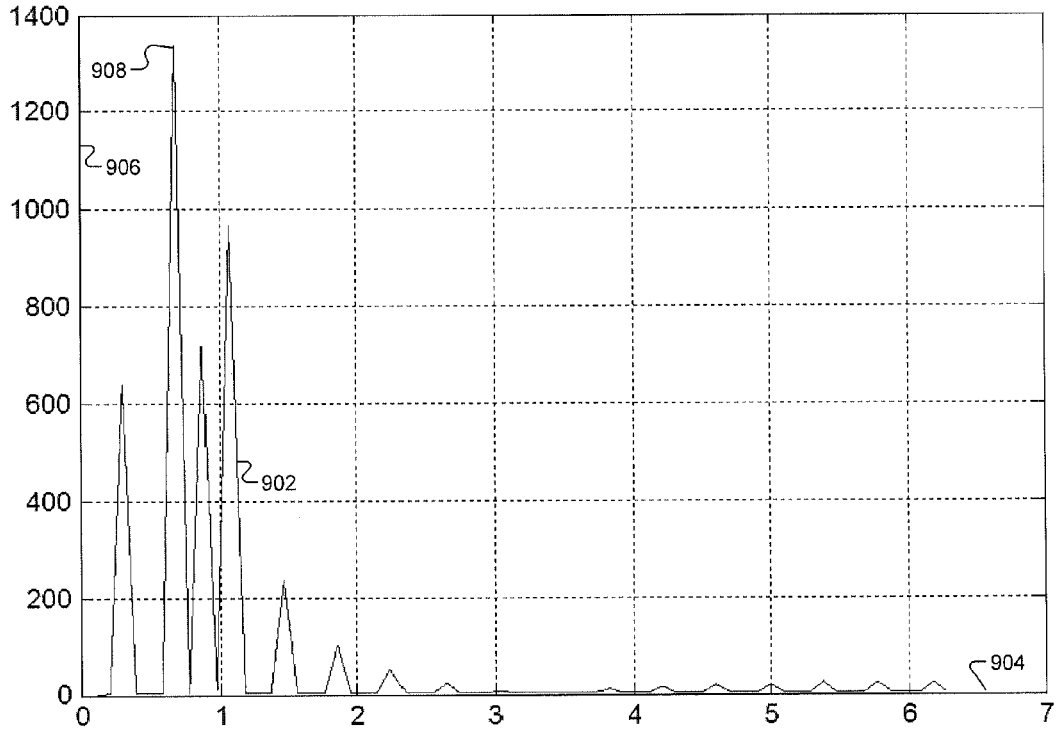

Referring now to FIG. 9, an energy spectral density 902 of the engine speed 802 is plotted with respect to an x-axis 904 and a y-axis 906. The x-axis 904 represents an inverse of the crank angle in 1/rad and is proportional to frequency in Hz. The y-axis 906 represents energy per crank angle inverse and is proportional to energy per frequency in J/Hz. For discussion purposes, the units of the y-axis 906 will be referred to as energy units. Since the engine speed 802 fluctuates due to the non-firing cylinders, the energy spectral density 902 includes multiple peaks with a peak at 908 having a relatively high magnitude of approximately 1350 energy units.

Figure 10:
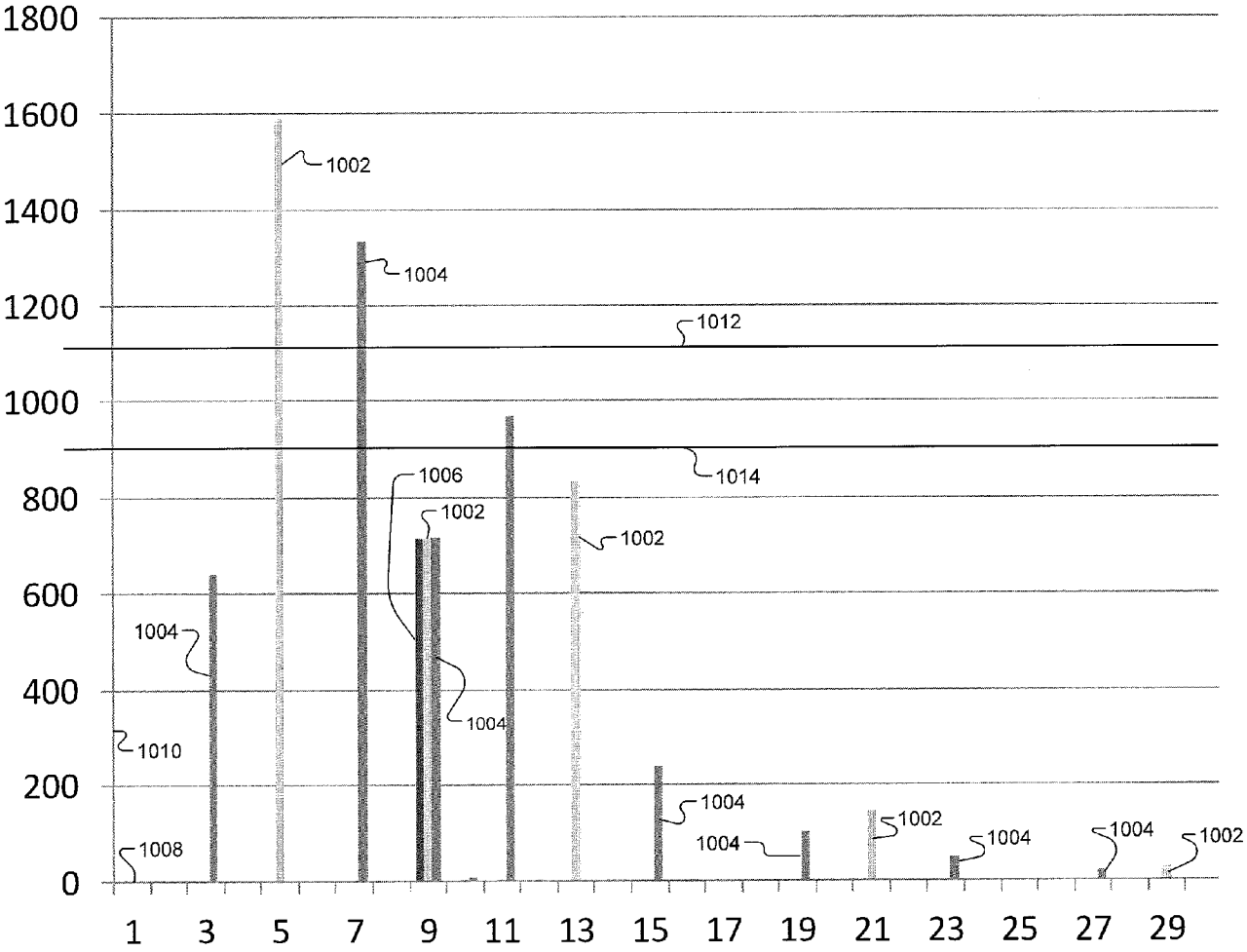
FIG. 10 is a bar graph illustrating an energy spectral density and criteria for adjusting a firing sequence according to the principles of the present disclosure.

Referring now to FIG. 10, energy spectral densities 1002, 1004, and 1006 correspond to the energy spectral densities 502, 702, and 902 plotted on a bar graph with respect to an x-axis 1008 and a y-axis 1010. The x-axis 1008 represents samples taken when performing a fast Fourier transform of the engine speeds 402, 602, and 802. In various implementations, engine speed is sampled at twice the Nyquist rate to generate an energy spectral density. Thus, the number of samples taken to generate the energy spectral density may be equal to one-half of the number of engine speed samples.

A system and method according to the present disclosure adjusts which cylinders are firing and/or the number of non-firing cylinders when energy spectral densities corresponding to cylinder deactivation are greater than a first threshold 1012 (e.g., 1125 energy units). Energy spectral densities illustrated in FIG. 10 that correspond to cylinder deactivation include the energy spectral densities 1004, 1006.

In one example, the number of deactivated cylinders are decreased (i.e., a cylinder is reactivated) when the energy spectral densities 1004, 1006 are greater than the first threshold 1012. In a second example, the pattern of the firing sequence corresponding to the energy spectral density 1004 is changed from alternating to consecutive when the energy spectral density 1004 is greater than the first threshold 1012. In a third example, the pattern of the firing sequence corresponding to the energy spectral density 1006 is changed from consecutive to alternating when the energy spectral density 1006 is greater than the first threshold 1012.

A system and method according to the present disclosure may increase the number of non-firing cylinders when the energy spectral densities 1004, 1006 are less than a second threshold 1014 (e.g., 925 energy units). For example, the number of non-firing cylinders may be increased when the energy spectral densities 1004, 1006 are less than the second threshold 1014 and the engine can satisfy a driver torque request if additional cylinder(s) are deactivated.

A driver may be more sensitive to engine vibrations at one frequency relative to engine vibrations at another frequency. Thus, the first and second thresholds 1012, 1014 may vary based on the corresponding frequency (or engine speed inverse). In addition, the rotating inertia of a powertrain changes as a transmission gear is changed. Changes in the rotating inertia of the powertrain affect the torque output and speed of an engine, which in turn affects a spectral density of the engine speed. Thus, the first and second thresholds 1012, 1014 may be weighted based on the transmission gear.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A system comprising:

a spectral density module that determines a spectral density of engine speed;

a firing sequence module that:

selects a first set of M cylinders of an engine to activate based on a driver torque request;

selects a second set of N cylinders of the engine to deactivate based on the driver torque request;

selects a firing sequence to activate the first set of M cylinders and to deactivate the second set of N cylinders, wherein the firing sequence specifies whether each cylinder of the engine is active or deactivated; and based on the spectral density, adjusts the firing sequence to at least one of:

adjust which cylinders of the engine are included in the first set and which cylinders of the engine are included in the second set; and adjust M and N, wherein M and N are integers greater than or equal to one.

2. The system of claim 1 wherein the firing sequence module adjusts the firing sequence to adjust which cylinders of the engine are included in the first set and which cylinders of the engine are included in the second set when the spectral density is greater than a predetermined value.

3. The system of claim 2 wherein:

the firing sequence module switches at least a portion of the firing sequence between an alternating pattern and a consecutive pattern when the spectral density is greater than the predetermined value;

the firing sequence alternates between a firing cylinder and a non-firing cylinder when the firing sequence has the alternating pattern; and the firing sequence includes at least one of consecutive firing cylinders and consecutive non-firing cylinders when the firing sequence has the consecutive pattern.

4. The system of claim 1 wherein the firing sequence module adjusts the firing sequence to adjust M and N when the spectral density is greater than a first predetermined value.

5. The system of claim 4 wherein the firing sequence module adjusts the firing sequence to decrease N when the spectral density is greater than the first predetermined value.

6. The system of claim 4 wherein the firing sequence module selectively adjusts the firing sequence to increase N when the spectral density is greater than the first predetermined value.

7. The system of claim 6 wherein:

the firing sequence module selectively adjusts the firing sequence to increase N when the spectral density is less than a second predetermined value; and the second predetermined value is less than the first predetermined value.

8. The system of claim 7 wherein the firing sequence module:

predicts a torque capacity of the engine after N is increased to a first quantity; and adjusts the firing sequence to increase N to the first quantity when the torque capacity is greater than the driver torque request.

9. The system of claim 1 wherein the spectral density is an energy spectral density representing an amount of energy associated with crankshaft movement with respect to an inverse of the engine speed.

10. The system of claim 1 wherein the spectral density is a power spectral density representing an amount of power associated with crankshaft movement with respect to an inverse of the engine speed.

11. A method comprising:

determining a spectral density of engine speed;

selecting a first set of M cylinders of an engine to activate based on a driver torque request;

selecting a second set of N cylinders of the engine to deactivate based on the driver torque request;

selecting a firing sequence to activate the first set of M cylinders and to deactivate the second set of N cylinders, wherein the firing sequence specifies whether each cylinder of the engine is active or deactivated; and based on the spectral density, adjusting the firing sequence to at least one of:

adjust which cylinders of the engine are included in the first set and which cylinders of the engine are included in the second set; and adjust M and N, wherein M and N are integers greater than or equal to one.

12. The method of claim 11 further comprising adjusting the firing sequence to adjust which cylinders of the engine are included in the first set and which cylinders of the engine are included in the second set when the spectral density is greater than a predetermined value.

13. The method of claim 12 further comprising switches at least a portion of the firing sequence between an alternating pattern and a consecutive pattern when the spectral density is greater than the predetermined value, wherein:

the firing sequence alternates between a firing cylinder and a non-firing cylinder when the firing sequence has the alternating pattern; and the firing sequence includes at least one of consecutive firing cylinders and consecutive non-firing cylinders when the firing sequence has the consecutive pattern.

14. The method of claim 11 further comprising adjusting the firing sequence to adjust M and N when the spectral density is greater than a first predetermined value.

15. The method of claim 14 further comprising adjusting the firing sequence to decrease N when the spectral density is greater than the first predetermined value.

16. The method of claim 14 further comprising selectively adjusting the firing sequence to increase N when the spectral density is greater than the first predetermined value.

17. The method of claim 16 further comprising selectively adjusting the firing sequence to increase N when the spectral density is less than a second predetermined value, wherein the second predetermined value is less than the first predetermined value.

18. The method of claim 17 further comprising:

predicting a torque capacity of the engine after N is increased to a first quantity; and adjusting the firing sequence to increase N to the first quantity when the torque capacity is greater than the driver torque request.

19. The method of claim 11 wherein the spectral density is an energy spectral density representing an amount of energy associated with crankshaft movement with respect to an inverse of the engine speed.

20. The method of claim 11 wherein the spectral density is a power spectral density representing an amount of power associated with crankshaft movement with respect to an inverse of the engine speed.

* * * * *